United States Patent [19]

Tabler

[11] Patent Number: 4,502,948

[45] Date of Patent: Mar. 5, 1985

[54] RECLAIMING USED LUBRICATING OIL

[75] Inventor: Donald C. Tabler, Bartlesville, Okla.

[73] Assignee: Phillips Petroleum Company, Bartlesville, Okla.

[21] Appl. No.: 595,133

[22] Filed: Mar. 30, 1984

[51] Int. Cl.[3] ..... C10M 11/00

[52] U.S. Cl. ..... 208/183; 208/181; 208/182; 208/251 R

[58] Field of Search ..... 208/182, 181, 183, 251 R

[56] References Cited

U.S. PATENT DOCUMENTS

| | | | |
|---|---|---|---|
| 2,446,489 | 8/1948 | Schaafsma | 196/16 |
| 3,930,988 | 1/1976 | Johnson | 208/182 |
| 4,029,569 | 6/1977 | Ivey, Jr. | 208/181 |
| 4,151,072 | 4/1979 | Nowack | 208/182 |
| 4,204,946 | 5/1980 | Johnson | 208/181 |
| 4,247,389 | 1/1981 | Johnson et al. | 208/181 |
| 4,383,915 | 5/1983 | Johnson | 208/183 |
| 4,431,523 | 2/1984 | Tabler et al. | 208/182 |
| 4,431,524 | 2/1984 | Norman | 208/181 |

*Primary Examiner*—Delbert E. Gantz
*Assistant Examiner*—A. McFarlane
*Attorney, Agent, or Firm*—Mark A. Montgomery

[57] ABSTRACT

A method for purifying used oil without the use of hydrogen comprising contacting a demetallized used oil with an acid such as sulfuric acid and an adsorbent such as clay.

16 Claims, 1 Drawing Figure

RECLAIMING USED LUBRICATING OIL

BACKGROUND OF THE INVENTION

This invention relates to a method for the treatment of used lubricating oils to obtain a purified oil product. This invention also relates to the removal of contaminants from used lubricating oil by a series of treatments of the used lubricating oil. In another aspect this invention relates to the process of producing a finished oil from a demetallized used oil without the use of hydrogen.

The large rise in crude prices of recent years has increased the interest in reclaiming used lubricating oils and with the ever-decreasing petroleum reserves, it becomes more and more essential that this used oil be saved and reused.

Also in recent years more and more additives have been employed in petroleum lubricating oils, the economic removal of these additives and impurities formed in used lubricating oils, so that the oil may be reused, has proven to be no small task.

Materials contained in a typical used crankcase oil that are undesirable if the oil is to be reused include sub-micron size carbon particles, atmospheric dust, metal and metal particles, detergents, pour point depressants, oxidation inhibitors, viscosity index improvers and resins. Besides lead, which is generally present at concentrations of 1 to 2.5 weight percent, appreciable amounts of zinc, barium, calcium, phosphorus and iron are also present in the used crankcase oil.

Recently, a technique of purifying used oil has been developed in which the used oil is reacted with an aqueous solution of an ammonium salt treating agent, then the water and light hydrocarbons are removed as vapor, the resulting oil phase-containing mass is separated by filtration, then an adsorbant to remove gum forming contaminants is added, and the resulting oil is hydrotreated by contacting it with hydrogen and a hydrotreating catalyst. Such a technique is described in U.S. Pat. No. 4,151,072 the disclosure of which is incorporated herein by reference. This process is satisfactory for most industrialized locations, but there are areas where hydrogen is either expensive or unavailable making it uneconomical to reclaim used lubricating oil in these areas.

It is an object of this invention to provide an improvement on the method disclosed in U.S. Pat. No. 4,151,072.

Another object of this invention is to produce a finished oil from a demetallized used oil without the use of hydrogen.

Another object of this invention is to provide a process for reclaiming a high purity lube oil stock from used lubricating oils.

A further object of this invention is to provide an improved process for removing both additives and solid contaminants from used lubricating oils.

Other aspects, objects, as well as the advantages of this invention will become apparent to one skilled in the art upon a study of the specification, the appended claims, and the drawings.

SUMMARY OF THE INVENTION

In accordance with this invention there is provided a process for reclaiming demetallized used lubricating oil comprising acid treating demetallized used lubricating oil followed by adsorbent treatment.

In accordance with a specific embodiment of the present invention, a process is provided for the production of an essentially pure finished oil stock from a used lubricating oil containing solid or ash forming contaminants comprising (a) demetallizing said oil;

(b) contacting the now demetallized oil from step (a) with an acid like sulfuric acid;

(c) phase separating the mixture of step (b) into an oil phase and an acid phase;

(d) contacting the resulting oil phase of step (c) with at least one adsorbent selected from the group consisting of activated carbon, silica gel, clay, bauxite and alumina;

(e) separating the adsorbent from the oil phase of step (d) resulting in a finished clear oil product.

More specifically, in accordance with one embodiment of this invention a process is provided for removing solid or ash-forming contaminants from used lubricating oils so as to provide an essentially ash-free clear oil suitable for various industrial purposes which comprises (a) contacting the used lubricating oil with an aqueous solution of a treating agent consisting essentially of an ammonium salt under conditions of temperature, pressure and time sufficient to disperse the agent in the used lubricating oil phase and to react the agent with the ash-forming components of the used oil;

(b) removing a major portion of water from the used lubricating oil-treating agent mixture or dispersion from step (a);

(c) separating the residual material from the oil mixture of step (b);

(d) mixing the separated oil from step (c) with a relatively small amount of sulfuric acid;

(e) phase separating the mixture of step (d) into an oil and an acid phase;

(f) contacting the resulting oil phase from step (e) with a clay;

(g) separating the oil and the particles from step (f) by filtration resulting in a finished clear oil product.

DETAILED DESCRIPTION OF THE INVENTION

Figure 1:
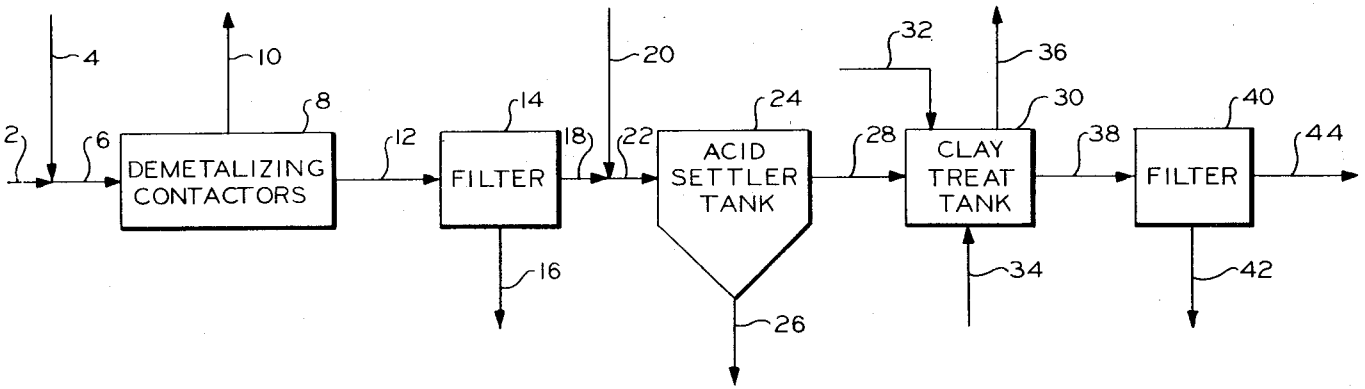
FIG. 1 illustrates an oil rerefining process of the instant invention. However, it is envisioned in this invention that the used or waste oil can be demetallized by other processes.

Waste oil enters via conduit 2 and is mixed with a demetallizing agent via conduit 4 and said admixture enters via conduit 6 a series of continuous stirred tank reactors 8. Water and light hydrocarbons (basically motor fuel fractions) are evaporated from said reactors 8 and taken away via conduit 10. Reactor effluent containing demetallized oil and spent demetallizing reagents and reaction products are sent via conduit 12 to a filter 14, preferably an enclosed horizontal tank, vertical leaf filter. The filter 14 is operated continually with intermittent washing off of accumulated filter cake via line 16. Filter effluent is mixed via conduit 18 with concentrated sulfuric acid 20, said mixture passing via conduit 22 to acid settling tank 24. Acid setting tank is preferably cone bottomed from which acid sludge passes via conduit 26 to disposal means. Acid treated oil is decanted from acid settling tank 24 via conduit 28 and passes to clay treating tank 30. Treating clay enters the clay treating tank 30 via conduit 32. Steam sparge is sent via conduit 34 to clay treating tank 30. Steam containing minor amounts of hydrocarbonaceous heteroatoms leave tank 30 via conduit 36. Decolorized and deodorized oil is sent via conduit 38 to filter 40 to remove spent clay for disposal via conduit 42. Product rerefined oil exits filter 40 via conduit 44.

The used lubricating oils treated by the process of this invention are primarily the discarded oils that have been used for internal combustion lubrication purposes such as crankcase oils, e.g., in gasoline or diesel engines. Other sources of oils include steam-turbine oils, transmission and gear oils, steam-engine oils, hydraulic oils, heat transfer oils and the like.

The oils used for the purposes named above are the refined lubricating cuts from paraffin-base, mix-base or napthenic crudes. Their viscosities are generally in the range from about 100 to about 1,800 SUS at 100° F. The oils also contain various additives such as oxidation inhibitors (e.g., barium, calcium and zinc alkylthiophosphates, di-t-butyl-p-cresol, etc.), anti-wear agents (e.g., organic lead compounds such as lead di-organophosphorodithioates, zincdialkyldithiophosphates, etc.), rust inhibitors (e.g., calcium and sodium sulfonates, etc.), dispersants (e.g., calcium and barium sulfonates and phenoxides, etc.), viscosity index improvers (e.g., polyisobutylenes, poly-(alkyl styrenes) etc.), detergents (e.g., calcium and barium salts of alkyl benzene sulfonic acids) and ashless-type detergents such as alkyl-substituted succinamides, etc.

The treating agents which are useful in the preliminary demetallization step of this invention are ammonium salts selected from the group consisting of ammonium sulfate, ammonium bisulfate, ammonium phosphate, diammonium hydrogen phosphate, ammonium dihydrogen phosphate, ammonium thiosulfate, ammonium polyphosphates such as ammonium metaphosphate, urea sulfate, guanidine sulfate, urea phosphate and guanidine phosphate and mixtures thereof. Said treating agents can be formed in situ if desired, and the precursors of said treating agents can be employed instead of part or all of the treating agent.

Although the concentration of treating agent in aqueous solution of treating agent is not critical and more dilute solutions can be used, the economics of the process are enhanced by the use of relatively concentrated solutions in order that the amount of water to be removed subsequently will not be great. Generally the concentration of treating agent in the aqueous solution will be withing the range of about 30 to 95 weight percent, typically about 80 weight percent, of that in aqueous solution at 25° C. saturated with the treating agent. Frequently some water will be found in used oil and in these instances the concentration of the treating agent can be adjusted accordingly.

In the process of this invention, the treating agent should be employed in an amount at least sufficient to react with all of the metal constituents in the used oil. Although the weight ratio of the treating agent to the used oil can vary greatly, depending in part upon the nature and concentration of metal-containing components in the oil and on the particular treating agent employed, generally it will be withing the range of about 0.002:1 to about 0.05:1, most often being within the range of about 0.005:1 to about 0.015:1, and typically being about 0.015:1. Although larger amounts of treating agent can be used, in most instances this would be wasteful of treating agent.

Water can be removed from the mixture resulting from the combination of the aqueous solution and the oil by any suitable means. Distillation is a preferred method of removing water. Generally, the distillation is carried out at a temperature in the range of about 100° to about 140° C. and a pressure in the range of about 5 to 25 psig for a period of time sufficient to effect removal of the major portion of the water. Light hydrocarbons contained in the oil that boil under the distillation conditions, gasoline, will be, of course, separated from the oil along with the water.

The solids are separated from the treated oil in any suitable manner. Currently filtering is a preferred technique. Generally, it is desirable to use a filter aid in the filtration process. Filter aids which are useful in the practice of the invention include those selected from the group consisting of diatomaceous earth, pearlite and cellulose fibers. The presently preferred filter aid is diatomaceous earth.

It is further currently preferred to expose the oil to a heat soak at a temperature in the range of about 320° C. to about 420° C. prior to the filtration step. Such procedure is disclosed in U.S. Pat. No. 4,247,389 the disclosure of which is incorporated herein by reference. Typically, such a heat soak is conducted at pressures in the range of about atmospheric to 400 psig.

The partially purified demetallized oil is next treated with a relatively small amount of an acid such as concentrated sulfuric acid (about 2 volume percent concentrated acid based on the volume of oil). A higher volume percent of concentrated acid could be used, but when treating a demetallized used oil 2 volume percent is sufficient to produce a clear oil. The desired reactions preferably require concentrated acid of about 95 to 98 weight percent $H_2SO_4$.

The solids are then settled out in a suitable manner.

The decolorizing and deodorizing step or steps is carried out by the addition of a small amount of an adsorbent such as clay. In clay-contacting, excellent results are attainable by mixing the oil with from about 0.2 to about 1 pound of clay per gallon of oil, preferably 0.25 to about 0.5 pounds/gallon, and heating the resultant slurry to from about 250° to about 450° F. for periods of 30 minutes to 3 hours. Times longer than about 3 hours encourage oxidation of the oil, while larger quantities of clay merely increase the amount of waste which must be disposed of. Oxidation must also be controlled by introducing an inert atmosphere such as $H_2$ or $N_2$ into the tank. Alternatively, a stream sparge will also provide excellent results, since, in addition to controlling oxidation, it helps to sweep impurities from the oil.

It is preferred that the oil and clay be separated as soon as possible after the contact time is met to obtain a better product. Separation of the oil-clay mixture can be accomplished by any well-known separation method such as filtering, and the resulting clear oil is the finished product.

Other adsorbents could be substituted for clay such as activated carbon, silica gel, bauxite, and alumina so long as they are compatible with the oil phase and improve color and odor.

The process of the present invention has advantages over straight clay treatment of demetallized oil, and conventional acid-clay treatment of waste oils. Straight clay treatment of demetallized oils requires more clay and higher temperatures (600° F.). This high temperature can give rise to cracking of the oil. On the other hand, conventional acid-clay treatment of waste oil that has not been demetallized requires more acid (6 to 10 volume percent concentrated acid), which results in low recovery of the oil. The treatment of this invention decolorizes and removes acid and gum-forming components.

The following table illustrates some of the characteristics of waste oil used in the examples.

TABLE I

Characterization of Waste Oil used in Tests

| Sample/Test | Company B | Company A |
|---|---|---|
| Sulfated Ash, wt. % | 0.75 | 0.84 |
| N, wt. % | 0.035 | 0.14 |
| S, wt. % | 0.68 | 0.60 |
| Cl, wt. % | 0.47 | 0.053 |
| PCB's, ppm | <5 | NA |
| Water, Vol. % | 3.2 | NA |
| Vol. % Distilling Below 600 F. | 10.0 | 3.9 |
| Viscosity at 40° C., CST | 64.27 | 136.04 |
| Viscosity at 100° C., CST | 9.26 | 13.44 |
| Viscosity Index | 122 | 102 |
| Density at 20° C. | 0.8904 | 0.9014 |
| Metals by plasma in ppm | | |
| Al | 13 | 6 |
| Cr | 3 | 3 |
| Cu | 17 | 26 |
| Fe | 144 | 76 |
| Mg | 208 | 3000 |
| Na | 41 | 5 |
| Pb | 1890 | 45 |
| Si | 32 | 13 |
| B | NA | 100 |
| Ba | 66 | 113 |
| Ca | 721 | 555 |
| K | 9 | 4 |
| Mn | 13 | 1 |
| Mo | 9 | 4 |
| P | 744 | 1190 |
| V | 4 | <0.3 |
| Zn | 693 | 1500 |

A further understanding of the present invention will be provided by the following description of a preferred embodiment of the present invention as illustrated in FIG. 1.

EXAMPLES

A sample of waste lubricating oil was obtained from a company in Guthrie, Okla. This sample was described as being made up exclusively of crankcase drainage from diesel engines. This oil was processed in a Phillips Rerefined Oil Process (PROP®) pilot plant through the filtration step according to the processing steps described in U.S. Pat. No. 4,247,389. The resulting oil, called demetallized oil, was virtually free of metal-containing components and particulate matter, but was still very dark in color and contained sulfur, oxygen and nitrogen compounds. This oil was used as the feedstock in Examples I, II and III, which follow.

EXAMPLE I

One hundred milliliters of the above demetallized oil was put into a 250 ml flask. Then 6 grams (equivalent to 0.5 pounds per gallon of oil) of Superfiltrol bleaching clay was added. The mixture was heated and stirred on a stirring hot plate to 587° F. under a flowing nitrogen purge. The system was held at 587° F. for 15 minutes, then the heat was turned off and the oil was allowed to cool to 350° F. under the nitrogen purge, and was then filtered through a precoat of diatomaceous earth. The color of the filtrate was determined using the ASTM D-1500 technique and apparatus. The color was found to be greater than 8.0 on the ASTM scale, which means that it was opaque under the conditions of the test.

EXAMPLE II

The procedure of Example I was repeated on the same feedstock, except that 12 grams of Superfiltrol bleaching clay was used at a temperature of 606° F. This amount of clay is equivalent to 1.0 pound of clay per gallon of oil. When the product was filtered, the color of the filtered oil was found to be 5.5 on the ASTM scale.

EXAMPLE III

Four hundred milliliters of the same feed of Example I demetallized oil were put into a 1000 ml beaker, the 16 ml of 95 percent sulfuric acid were added to the oil while stirring. The mixture was stirred at room temperature for another 45 minutes, then the stirring was stopped, and the mixture was allowed to stand quietly for 2 days. At the end of this time, the treated oil was decanted away from the settled acid sludge. Next, 100 ml of this acid-treated oil was put into a 250 ml flask along with 3 grams of Superfiltrol bleaching clay (equivalent to 0.25 pound of clay per gallon of oil). The mixture was heated and stirred under a nitrogen purge to 250° F., and held at the temperature for 15 minutes. It was then filtered through a pre-coat of diatomaceous earth. The color of the filtered oil was found to be less than 3.0 on the ASTM scale.

EXAMPLE IV

A sample of waste lubricating oil was obtained from a company in Mississippi. This was a typical mixed waste oil sample from multiple source including drainage from gasoline engine diesel engines, and industrial oils. A portion of this oil was demetallized in the laboratory according to the following procedure. Two hundred grams of the waste oil were mixed with 1.64 grams of diammonium phosphate dissolved in 12 ml of water. The mixture was heated slowly to 250° F. in order to react the phosphate with the metal-containing component, and then to remove the water by evaporation. Then the mixture was heated to 350° F. to complete the removal of volatiles, and transferred into a 500 ml flask. It was then heated to 626° F. under a flowing nitrogen purge, and held at this temperature for 1 hour to complete the heat-soaking reactions. It was then cooled to 450° F., and 2 grams of diatomaceous earth were added. The cooling was continued to 350° F., when it was filtered through a precoat of diatomaceous earth. The filtrate was virtually free of metal-containing components and particulates, but was still very dark in color. Next 100 ml of this demetallized oil was transferred to a 250 ml flask along with 12 grams of Superfiltrol bleaching clay. This is equivalent to 1 pound of clay per gallon of oil. The mixture was heated and stirred under a nitrogen purge to 608° F., and held at this temperature for 15 minutes. It was then cooled to 350° F., and filtered through a precoat of diatomaceous earth. The color of the filtrate was found to be 5.0 on the ASTM scale.

EXAMPLE V

Two hundred fifty milliliters of the same feed of Example IV demetallized oil prepared according to the method described in Example IV was put into a 600 ml beaker. Then 5 ml of 98 percent sulfuric acid was added with stirring. The stirring was continued at room temperature for 1 hour, then the mixture was allowed to settle for 2 days. At the end of this time, the treated oil was decanted away from the settled acid sludge. Next, 125 ml of the treated oil was put into a 250 ml flask along with 9 grams of Superfiltrol bleaching clay. (Equivalent to 0.6 pound of clay per gallon of oil.) The mixture was heated with stirring to 450° F. and held at this temperature for 15 minutes. It was then cooled to 350° F., and filtered through a pre-coat of diatomaceous earth. The color of the filtrate was found to be 2.5 on the color scale.

EXAMPLE VI

For this test, the starting material was the original waste oil sample from Jackson, Miss. (Example IV). The oil was first dried by putting 400 ml of the oil into a 1000 ml beaker and heating with stirring at 250° F. for 30 minutes. It was then cooled to room temperature, and 24 ml of 98 percent sulfuric acid was added with stirring. The stirring was continued at room temperature for 1 hour, then the mixture was allowed to settle overnight (about 17 hours). The acid-treated oil was decanted away from the settled acid sludge. Next, 100 ml of this oil was mixed with 12 grams of Superfiltrol bleaching clay at 450° F. The contacting time was 15 minutes. The oil clay mixture was filtered at 350° F. The color of the Filtrol oil was found to be 4.0 on the ASTM scale. The method used in Example VI is typical of the old well known acid-clay method of rerefining waste oils.

A summary table of these six examples is as follows:

TABLE II

| Example | I | II | III | IV | V | VI |
|---|---|---|---|---|---|---|
| Source of oil | Co. A | Co. A | Co. A | Co. B | Co. B | Co. B |
| Previous Demetallization | Yes | Yes | Yes | Yes | Yes | No |
| Vol % $H_2SO_4$ (98 wt. %) | 0 | 0 | 3.85 | 0 | 2.0 | 6.0 |
| Clay Dosage, Lb/Gal | 0.5 | 1.0 | 0.25 | 1.0 | 0.6 | 1.0 |
| Temp. of Clay Treatment °F. | 587 | 606 | 250 | 608 | 450 | 450 |
| Color of Prod. ASTM | >8 | 5.5 | <3 | 5.0 | 2.5 | 4.0 |

In the above six examples, Examples III and V illustrate the invention. The other examples illustrate other, less successful methods of making light colored refined oil. For Examples I and II show the effect of using bleaching clay alone with demetallized oil at two different levels of clay treatment. It can be seen that even at a clay dosage of 1 pound per gallon of oil, and a treating temperature of over 600° F., a darker-colored oil is produced than is obtained in Example III with less clay and lower treating temperature.

Examples IV, V and VI apply to a different waste oil sample. In this series, Example IV shows the effect of using clay alone with demetallized oil, Example V illustrates the invention, and Example VI illustrates the use of the old acid-clay method, starting with the original waste oil. It can be seen that the method of the invention gives lighter-colored oil with less clay than does either of the other two methods.

From the foregoing, it should be apparent that the present invention provides an improved method of purifying used lubricating oil without the use of hydrogen. Reasonable variations and modifications can obviously be made without departing from the spirit and scope of the presently disclosed invention.

What is claimed is:

1. A process for reclaiming demetallized used lubricating oil comprising treating said demetallized oil with acid to clear the oil, contacting the acid treated clear oil with an adsorbent to decolorize and deodorize said clear oil.

2. A process according to claim 1 wherein said acid is concentrated sulfuric acid in the concentration range of about 1 to about 5 volume percent and said adsorbent is clay in the concentration range of about 0.2 to about 1 pound of clay per gallon of oil.

3. A process according to claim 2 wherein the amount of said sulfuric acid is about 2 volume percent concentrated acid based on the volume of oil.

4. A process for the production of an essentially pure oil stock from a used lubricating oil containing undesirable components comprising:

(a) contacting said used lubricating oil with a demetallizing agent to form an oil phase essentially free of metal contaminants;

(b) contacting the now demetallized oil from step (a) with a relatively small amount of concentrated acid;

(c) allowing the acid treated oil of (b) to phase separate into an oil phase and an acid phase;

(d) contacting the resulting oil phase from step (c) with at least one adsorbent selected from the group consisting of activated carbon, silica gel, clay, bauxite and alumina;

(e) separating the oil and particles from step (d) resulting in a finished clear oil product.

5. A process according to claim 4 wherein said acid is sulfuric acid in the concentration of less than about 6 volume percent concentrated acid based on the volume of oil.

6. A process according to claim 5 wherein the amount of said sulfuric acid is about 2 volume percent concentrated acid based on the volume of oil.

7. A process according to claim 4 wherein said adsorbent is in the range of about 0.2 to about 1 pound per gallon of oil.

8. A process according to claim 4 wherein said settled oil is contacted with said adsorbent in the temperature range of about 250° to 450° F.

9. A process according to claim 4 wherein said adsorbent is clay that decolorizes and deodorizes said oil.

10. A process for the production of essentially pure oil stock from a used lubricating oil containing undesirable components comprising:

(a) contacting said used lubricating oil with an aqueous solution of a treating agent capable of reacting with essentially all of the ash-forming metal constituents in said used lubricating oil rendering them removable under conditions sufficient to disperse said agent in said lubricating oil and reacting a sufficient amount of said agent with said metals of said lubricating oil;

(b) removing a major portion of the water from the mixture resulting from combining said aqueous solution and said lubricating oil;

(c) separating solids from the oil resulting from step (b) to obtain a demetallized partially purified oil;

(d) contacting said demetallized partially purified oil of step (c) with a relatively small amount of concentrated sulfuric acid;

(e) settling the mixture of step (d) to form an oil phase and an acid phase;

(f) contacting the resulting settled oil from step (e) with at least one adsorbent selected from the group consisting of activated carbon, silica gel, clay, bauxite and alumina;

(g) separating the oil and the particles from step (f) by filtration resulting in a finished clear product.

11. A process according to claim 10 wherein said treating agent is comprised essentially of an ammonium salt selected from the group consisting of ammonium sulfate, ammonium bisulfate, ammonium phosphate, diammonium hydrogen phosphate, ammonium dihydrogen phosphate and mixtures thereof.

12. A process according to claim 10 wherein the concentration of ammonium salt in said aqueous solution of a treating agent is in the range of 30 to 95 weight percent of that in an aqueous solution at 25° C. saturated with a treating agent.

13. A process according to claim 10 wherein said treating agent is present in an amount such that the ratio of treating agent to used lubricating oil is in the range of about 0.002:1 to about 0.05:1.

14. A process according to claim 10 wherein the amount of said sulfuric acid is about 2 volume percent concentrated acid based on the volume of oil.

15. A process according to claim 10 wherein said adsorbent is in the range of about 0.2 to about 1 pound per gallon of oil.

16. A process according to claim 10 wherein said adsorbent is clay that decolorizes and deodorizes said oil.

* * * * *